United States Patent [19]

Dobson

[11] 4,350,291

[45] Sep. 21, 1982

[54] RAILWAY RAIL-FASTENING CLIP AND A RAILWAY RAIL-AND-FASTENING ASSEMBLY

[75] Inventor: George D. Dobson, Baulkham Hills, Australia

[73] Assignee: Pandrol Limited, London, England

[21] Appl. No.: 120,922

[22] Filed: Feb. 12, 1980

[30] Foreign Application Priority Data

Feb. 15, 1979 [GB] United Kingdom ..... 7905443

[51] Int. Cl.[3] ..... E01B 9/48

[52] U.S. Cl. ..... 238/349

[58] Field of Search ..... 238/349

[56] References Cited

U.S. PATENT DOCUMENTS 3,700,167 10/1972 Jennings et al. ..... 238/349

FOREIGN PATENT DOCUMENTS 869385 5/1961 United Kingdom ..... 238/349

884237 12/1961 United Kingdom ..... 238/349

*Primary Examiner*—Richard A. Bertsch

*Attorney, Agent, or Firm*—Norbert P. Holler; Charles A. Blank

[57] ABSTRACT

A metal plate stands on a cross tie above an opening in the tie and a rail clip has a substantially straight leg which is driven into the opening, bears upwardly and is at most 2 mm. below a flat bottom of the plate. Second and third parts of the clip bear downwardly on the upper face of the rail flange and the upper face of the plate, respectively. This assembly may be made from an existing assembly in which a spike had its head overlying the rail flange and holding the rail down, the making of the new assembly including the step of forming the opening in the tie without moving the plate. A rail clip especially suitable for use in the assembly is made by bending a metal rod to a shape in which, when the substantially straight leg is horizontal and the lowest points on the second and third parts lie in a horizontal plane, a vertical plane, parallel to a vertical plane containing the axis of the leg, intersects both the leg and the third part, and the minimum spacing between the third part and the leg is ½ to 2 times the rod thickness.

5 Claims, 10 Drawing Figures

FIG. 3.
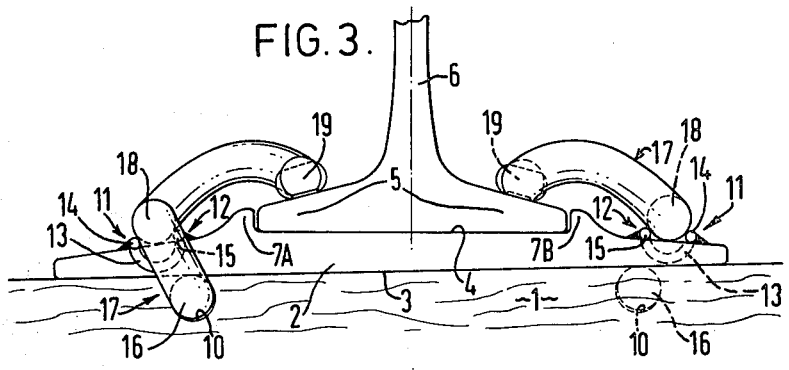
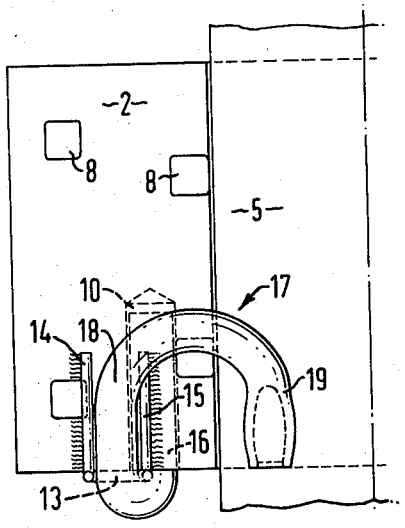
FIG. 4.
FIG. 5.
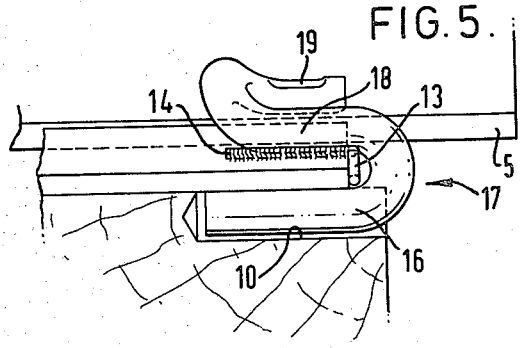

RAILWAY RAIL-FASTENING CLIP AND A RAILWAY RAIL-AND-FASTENING ASSEMBLY

According to one aspect of the invention, an assembly on a railway track comprises a cross tie (also known as a sleeper and called by that name in the following description), a metal plate with a flat bottom lying on the sleeper above an opening in the sleeper, an upward projection on the plate, a flange-footed rail lying on the plate located partly by said projection, and a rail clip comprising an upwardly bearing, substantially straight leg driven into said opening, and at most 2 mm. below the flat bottom of the plate, a second part bearing downwardly on the upper face of the flange of the rail and a third part, connected to the said leg only by a single reverse bend, bearing downwardly on the upper face of the plate at a location which is further from the rail than is said leg, considering only the horizontal direction.

The sleeper may be of wood and the opening in it may be parallel to the length of the rail. The opening may break the upper surface of the sleeper so that the substantially straight leg of the clip makes direct contact with the flat bottom of the plate. In that case the opening may be a hole drilled in the sleeper, possibly whilst the plate is fixed to it, or it may be formed by gouging a groove out of the top of the sleeper whilst the plate is not lying on the sleeper. Alternatively, the opening may be a hole drilled in the sleeper, possibly whilst the plate is fixed to it, the hole not breaking the upper surface of the sleeper so that the substantially straight leg bears upwardly on a thin layer (no more than 2 mm. thick) of wood, or other material if the sleeper is not a wooden one, which in turn bears upwardly on the flat bottom of the sleeper.

According to a second aspect of the invention, there is provided a method of making a new assembly on a railway track, starting with an existing assembly including a sleeper, a metal plate with a flat bottom lying on the sleeper, an upward projection on the plate, a flange-footed rail lying on the plate located partly by said projection and at least one spike passing downwardly through a hole in the plate and into the sleeper, with its head overlying an edge of the rail flange, the method comprising forming an opening in the sleeper whilst the plate is still in its previous position on the sleeper and driving into the opening a substantially straight leg of a rail clip, so that the leg is at most 2 mm. below the flat bottom of the plate and is caused to bear upwardly, a second part of the clip is caused to bear downwardly on the upper face of the flange of the rail on one side of the rail and a third part of the clip is caused to bear downwardly on the upper face of the plate at a location which is further from the rail than is said leg, considering only the horizontal direction.

The rail clip may be of any convenient shape, for example a clip which, according to a third aspect of the invention, comprises a rod of resilient metal, at least 8 mm. thick, which has been bent so that it comprises, proceeding from one end of the rod to the other end, a first portion which constitutes a substantially straight leg, a second portion in the form of a reverse bend, a third portion, a fourth portion in the form of a reverse bend and then a fifth portion which terminates at said other end of the rod, the configuration being such that when the clip is in a position in which the first portion is horizontal and the lowest points at opposite ends of the first portion lie in the same horizontal plane as one another and the lowest points on the third and fifth portions lie in the same horizontal plane as one another, which plane is higher than the first-mentioned plane, when the clip is viewed from above the axes of the third and fifth portions appear to be on opposite sides of the axis of the first portion, a first imaginary vertical plane intersecting the third portion and said leg and being parallel to a second imaginary plane which contains the axis of said leg and the least spacing between the third portion and said leg being between half the thickness and twice the thickness of the rod.

Preferably such a clip is made from a rod with a length less than 18 times its thickness and/or it has a flat surface on the underneath side of its fifth portion.

Figure 1:
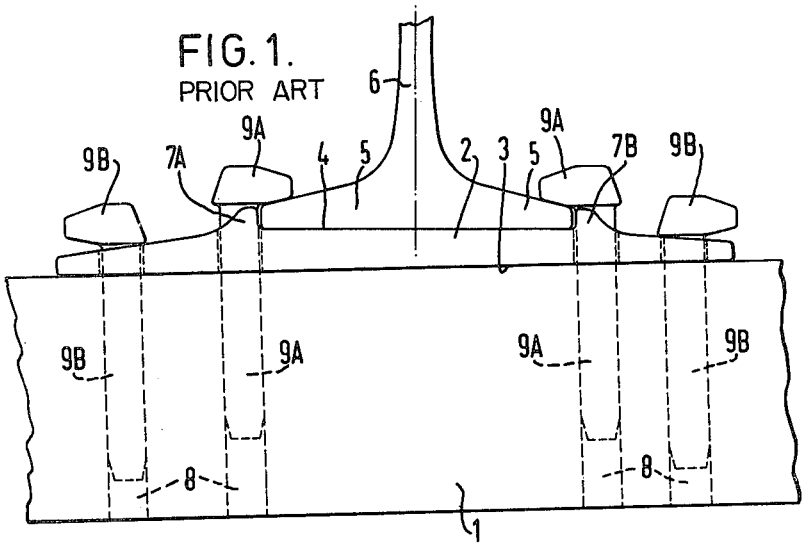
FIG. 1. PRIOR ART
FIG. 1 shows an end view of a conventional rail-and-fastening assembly.
Figure 2:
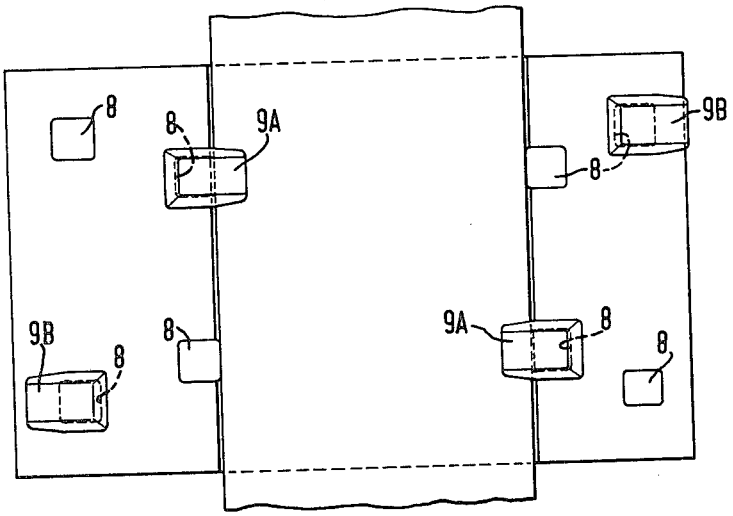
FIG. 2. PRIOR ART
FIG. 2 shows a plan view of the same assembly.
Figure 6:
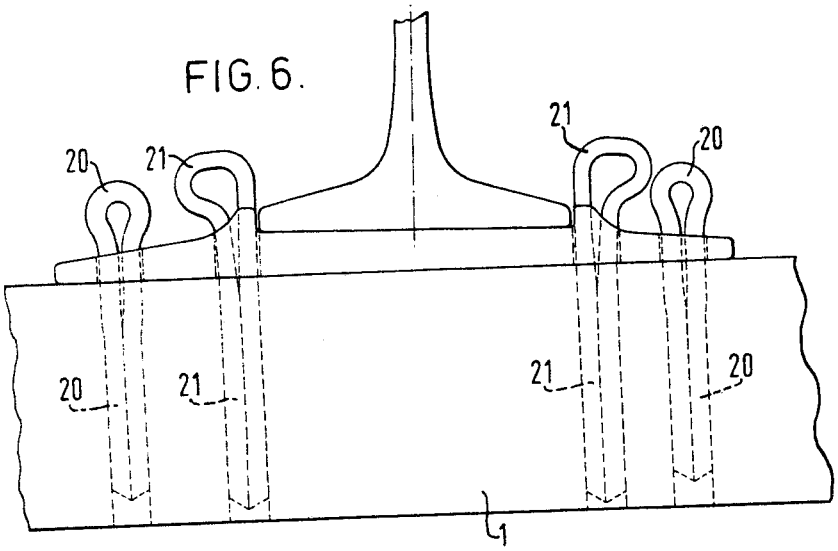
Figure 7:
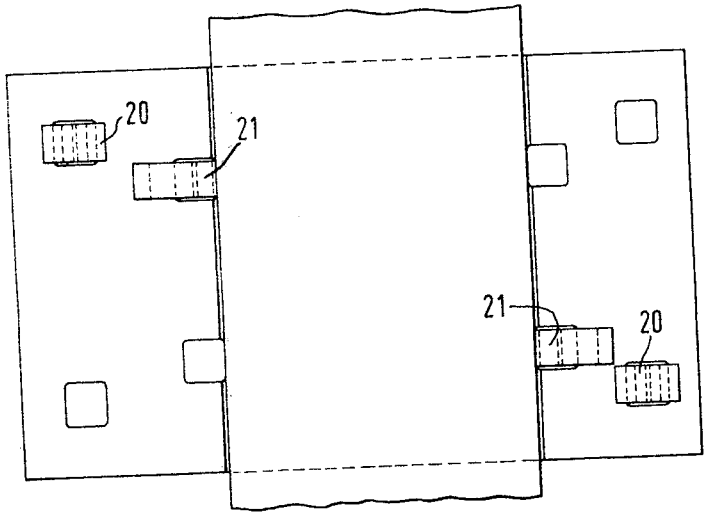
Figure 8:
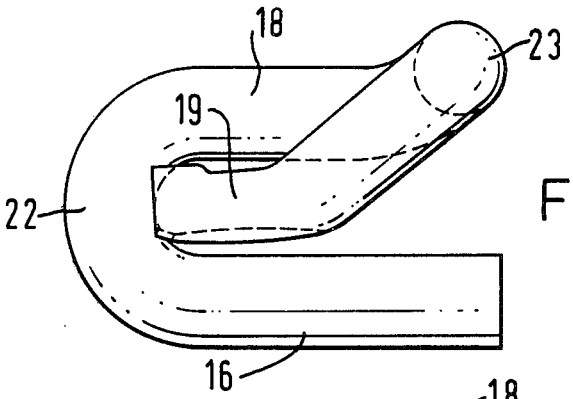
Figure 9:
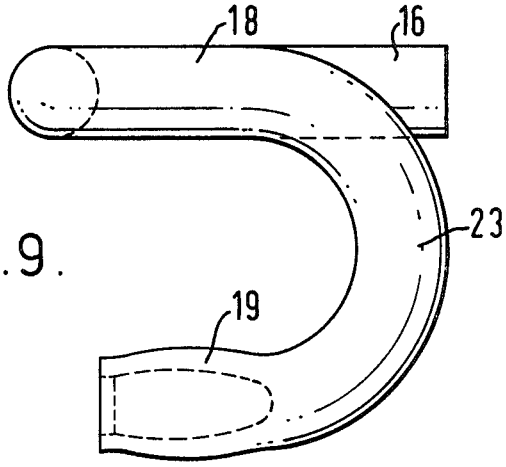
Figure 10:
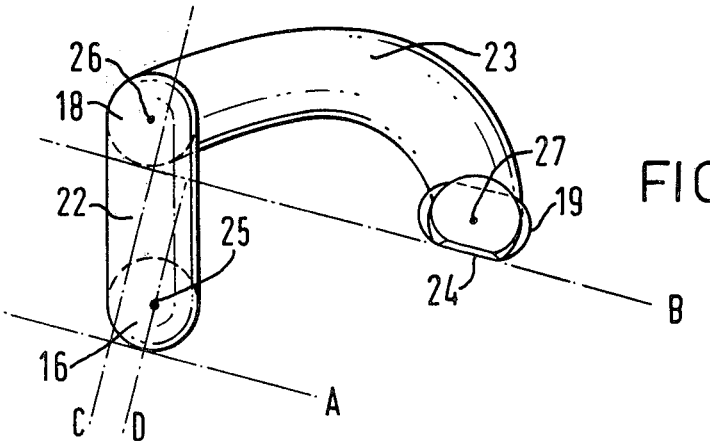

FIG. 3 shows an end view of a rail-and-fastening assembly according to the first aspect of the invention, FIG. 4 shows a plan view of part of the same assembly, FIG. 5 shows a side view of part of the same assembly, FIGS. 6 and 7 show, by views corresponding to those of FIGS. 1 and 2, spikes which are present in the assembly of FIGS. 3 to 5 but are not shown in those Figures, for the sake of clarity, FIG. 8 shows a rail clip according to the third aspect of the invention, FIG. 9 shows a plan view of the same clip, and FIG. 10 shows an end view of the same clip.

FIG. 1 shows a wooden railway sleeper 1 on which lies a plate 2 having a flat bottom 3 and an inclined upper flat face 4 on which stands the flange 5 of a railway rail having a web 6. To the right of the plate and rail shown there are a further plate lying on the same sleeper and a further rail standing on that plate. There are two upward projections 7A and 7B on the plate for locating the rail, although it is possible to have only one such projection. The part of the plate to the left of the projection 7A has a greater length (measured from left to right in FIG. 1) than has the part of the plate to the right of the projection 7B. At each end of the plate there are four holes 8 through the plate to receive spikes although only four of the holes actually receive spikes in the illustrated case, these being two dog spikes 9A the heads of which overlie the rail flange and hold the rail down on the plate, and hold the plate down on the sleeper, and two dog spikes 9B which hold the plate down on the sleeper.

To convert the assembly shown in FIGS. 1 and 2 to an assembly according to FIGS. 3 to 7, the spikes 9B are withdrawn and, with the plate still held down on to the sleeper by the spikes 9A, holes 10 of circular cross-section parallel to the length of the rail are so drilled, in opposite directions, in the sleeper that they break the upper surface of the sleeper and the drilling tool makes contact with the flat bottom of the plate. It would be useful to form a line of weld material at about the location 11 on the upper surface of the plate at each end of it, or, better still, a line of weld material there and at about the location 12, but it is preferred to take a substantially U-shaped member, bend its two limbs 14 and 15 so that they lie in a plane perpendicular to that of the interconnecting portion 13 and weld the limbs 14 and 15 to the upper surface of the plate, at each end of the plate. Then straight legs 16 of two rail clips 17 are driven, in opposite directions, into the holes 10 so that they make direct contact with, and bear upwardly upon, the flat bottom 3 of the plate and they are parallel to the length of the rail. Parts 18 and 19 of the clips bear downwardly on the upper surface of the plate and the upper surface of the flange of the rail, respectively, the parts 18 being between the limbs 14 and 15 which prevent them moving any substantial extent towards or away from the rail. The parts 18 bear on the plate at locations which are further from the rail (considering only the horizontal direction) than are the legs 16, that is to say, in the case of the clip shown in the left-hand side of FIG. 3, the location concerned is further to the left than is the leg 16 of that clip. Then two lockspikes 20 are driven in two of the holes 8 and into the sleeper (or this could be done before the drilling operation and even before removal of the spikes 9B) and the two spikes 9A are removed and replaced by gauge lockspikes 21.

The leg 16 of the clip shown in FIGS. 8 to 10 is joined to the part 18 by a reverse bend 22 and the parts 18 and 19 are connected to one another by a reverse bend 23. The clip is made by bending a red-hot resilient steel rod of circular cross-section, of diameter at least 8 mm. and of length less than 18 times its diameter. A flat surface 24 is formed on the underneath side of the part 19 and this is parallel to and makes direct contact with the upper face of the flange of the rail.

FIG. 10 shows parallel planes A and B. When the clip is turned into such a position that the leg 16 is horizontal, the plane A, containing the lowest points at opposite ends of the leg 16, is horizontal and the plane B, containing the lowest points on the parts 18 and 19, is also horizontal, the planes C and D are vertical. The plane D contains the axis 25 of the leg 16 and the plane C, parallel to the plane D, intersects the leg 16 and the part 18. Then, when the clip is viewed from above, the axes 26 and 27 of the parts 18 and 19 of the clip appear to be on opposite sides of the axis 25. The least spacing between the leg 16 and the part 18 of the clip is between half and twice the diameter of the rod. If, as shown in FIG. 3, the thickness of the plate 2 is greater just above the leg 16 of the left-hand clip than it is just above the leg 16 of the right-hand clip, the leg 16 of the left-hand clip will, in the unstressed state of the clip before driving of the clip, be lower in relation to the parts 18 and 19 of the clip than is the case with the right-hand clip, in order to allow for the two different thicknesses of the plate.

I claim:

1. An assembly on a railway track comprising a cross tie, portions of the tie defining an opening in it, a metal plate with a flat bottom lying on the tie, an upward projection on the plate, a flange-footed rail lying on the plate, and a rail clip comprising an upwardly bearing, substantially straight leg driven into said opening, the uppermost part of said leg lying at most 2 mm. below the flat bottom of the plate, a second part bearing downwardly on the upper face of the flange of the rail and a third part, connected to said leg only by a single reverse bend, bearing downwardly on the upper face of the plate at a location which is further from the rail than is said leg, considering only the horizontal direction, said assembly further comprising a second upward projection on the plate, the flange of the rail being between the two projections and located by both of them, portions of the tie defining a second opening in it, the two openings being one on each side of the rail flange, and a second rail clip comprising an upwardly bearing substantially straight leg driven into the second opening, the uppermost part of said leg lying at most 2 mm. below the flat bottom of the plate, a second part bearing downwardly on the upper face of the flange of the rail and a third part, connected to said leg only by a single reverse bend, bearing downwardly on the upper face of the plate further from the rail than is said leg of the second clip, considering only the horizontal direction.

2. An assembly according to claim 1 wherein the first mentioned clip has been made by bending a metal bar and said first mentioned leg is substantially parallel to the length of the rail.

3. A rail clip, comprising a rod of resilient metal, at least 8 mm. thick, which has been bent so that it comprises, proceeding from one end of the rod to the other end, a first portion which constitutes a substantially straight leg, a second portion in the form of a reverse bend, a third portion, a fourth portion in the form of a reverse bend and then a fifth portion which terminates at said other end of the rod, the configuration being such that when the clip is in a position in which the first portion is horizontal and the lowest points at opposite ends of the first portion lie in the same horizontal plane as one another and the lowest points on the third and fifth portions lie in the same horizontal plane as one another, which plane is higher than the first-mentioned plane, when the clip is viewed from above the axes of the third and fifth portions appear to be on opposite sides of the axis of the first portion, a first imaginary vertical plane intersecting the third portion and said leg and being parallel to a second imaginary vertical plane which contains the axis of said leg and the least spacing between the third portion and said leg being between half the thickness and twice the thickness of the rod.

4. A rail clip according to claim 3 made from a rod with a length less than 18 times its thickness.

5. A rail clip according to claim 3 having a flat surface on the underneath side of its fifth portion.

* * * * *